US007338210B1

(12) United States Patent
Fultz et al.

(10) Patent No.: US 7,338,210 B1
(45) Date of Patent: Mar. 4, 2008

(54) BIG GAME STORAGE AND TRANSPORTATION BAG

(76) Inventors: Michael Fultz, 464 Stoneglen St., Collegeville, PA (US) 19426; Michele Fultz, 464 Stoneglen St., Collegeville, PA (US) 19426

( * ) Notice: Subject to any disclaimer, the term of this patent is extended or adjusted under 35 U.S.C. 154(b) by 394 days.

(21) Appl. No.: 11/139,361

(22) Filed: May 26, 2005

Related U.S. Application Data

(60) Provisional application No. 60/619,616, filed on Oct. 14, 2004.

(51) Int. Cl.
*B65D 33/06* (2006.01)

(52) U.S. Cl. ..... 383/16; 383/66; 383/907

(58) Field of Classification Search ..... 383/16, 383/907; 224/580
See application file for complete search history.

(56) References Cited

U.S. PATENT DOCUMENTS 4,790,051 A * 12/1988 Knight ..... 27/28
5,094,344 A * 3/1992 Savage ..... 206/315.1
5,370,287 A * 12/1994 Cormier ..... 224/153
5,761,992 A 6/1998 Gallo
6,253,569 B1 7/2001 Hall
6,286,674 B1 * 9/2001 Richard et al. ..... 206/315.9
6,502,676 B2 * 1/2003 Dexheimer ..... 190/108
6,508,077 B1 1/2003 Vander Boegh
6,585,137 B1 * 7/2003 Archuleta ..... 224/617

* cited by examiner

*Primary Examiner*—Nathan J. Newhouse
*Assistant Examiner*—Jack Morgan

(57) ABSTRACT

A storage and transportation mechanism for game animals after they have been killed and cleaned. The storage and transportation mechanism is a nylon bag with a top-mounted opening that can be folded back for placement of both dead game animals and volumes of ice to keep the dead game animals preserved for a longer period of time. Furthermore, the bag has a plurality of external nylon carrying straps and also has extra storage room for antlers, should this feature be needed.

7 Claims, 2 Drawing Sheets

BIG GAME STORAGE AND TRANSPORTATION BAG

I. CROSS-REFERENCE TO RELATED APPLICATIONS

This application claims the benefit of U.S. Provisional Application No. 60/619,616, filed Oct. 14, 2004.

II. BACKGROUND OF THE INVENTION

The present invention concerns that of a new and improved storage and transportation mechanism for game animals after they have been killed and cleaned.

III. DESCRIPTION OF THE PRIOR ART

U.S. Pat. No. 6,253,569, issued to Hall, discloses a pliable and foldable water impervious and insulated, zippered storage container for preserving game meat from a harvested animal such as a deer.

U.S. Pat. No. 5,761,992, issued to Gallo and U.S. Pat. No. 6,508,077, issued to Vander Boegh, disclose additional storage containers for holding and preserving game animals.

IV. SUMMARY OF THE INVENTION

The present invention concerns that of a new and improved storage and transportation mechanism for game animals after they have been killed and cleaned. The storage and transportation mechanism is a nylon bag with a top-mounted opening that can be folded back for placement of both dead game animals and volumes of ice to keep the dead game animals preserved for a longer period of time. Furthermore, the bag has a plurality of external nylon carrying straps and also has extra storage room for antlers, should this feature be needed.

There has thus been outlined, rather broadly, the more important features of a storage and transportation mechanism for game animals that the detailed description thereof that follows may be better understood and in order that the present contribution to the art may be better appreciated. There are, of course, additional features of the storage and transportation mechanism for game animals that will be described hereinafter and which will form the subject matter of the claims appended hereto.

In this respect, before explaining at least one embodiment of the storage and transportation mechanism for game animals in detail, it is to be understood that the storage and transportation mechanism for game animals is not limited in its application to the details of construction and to the arrangements of the components set forth in the following description or illustrated in the drawings. The storage and transportation mechanism for game animals is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present storage and transportation mechanism for game animals. It is important, therefore, that the claims be regarded as including such equivalent constructions insofar as they do not depart from the spirit and scope of the present invention.

It is therefore an object of the present invention to provide a storage and transportation mechanism for game animals which has all of the advantages of the prior art and none of the disadvantages.

It is another object of the present invention to provide a storage and transportation mechanism for game animals which may be easily and efficiently manufactured and marketed.

It is another object of the present invention to provide a storage and transportation mechanism for game animals which is of durable and reliable construction.

It is yet another object of the present invention to provide a storage and transportation mechanism for game animals which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
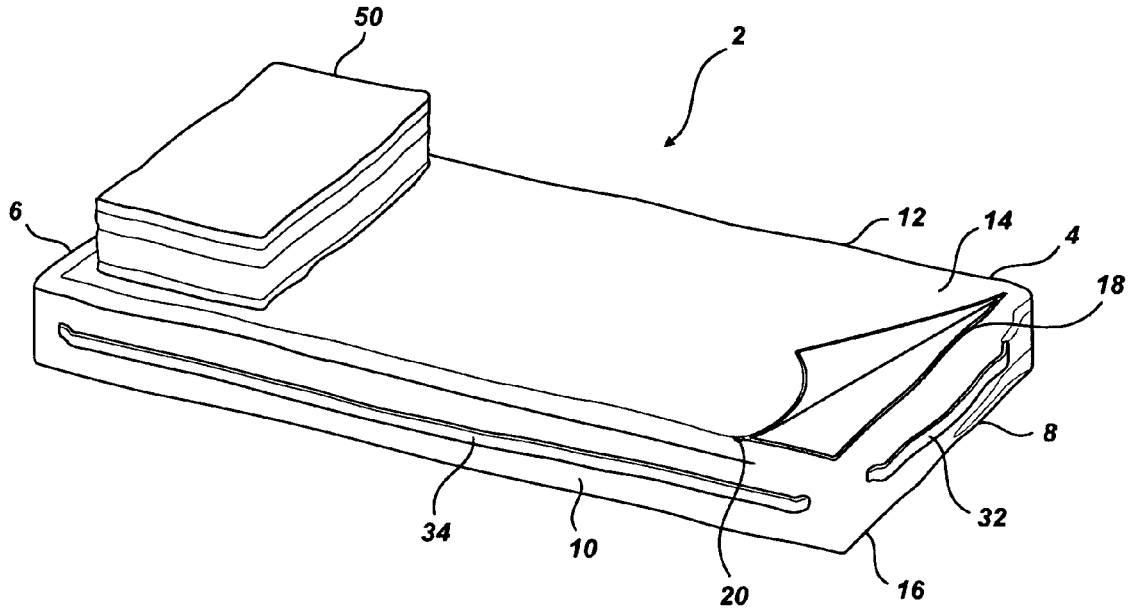
FIG. 1 shows a perspective view of the storage apparatus.
Figure 2:
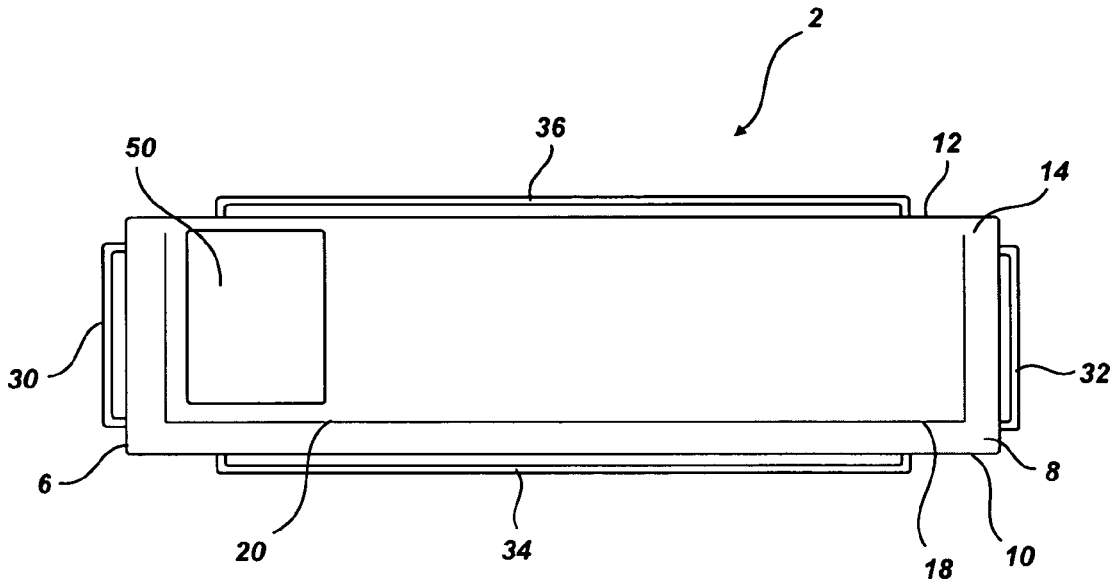
FIG. 2 shows a top view of the storage apparatus.
Figure 3:
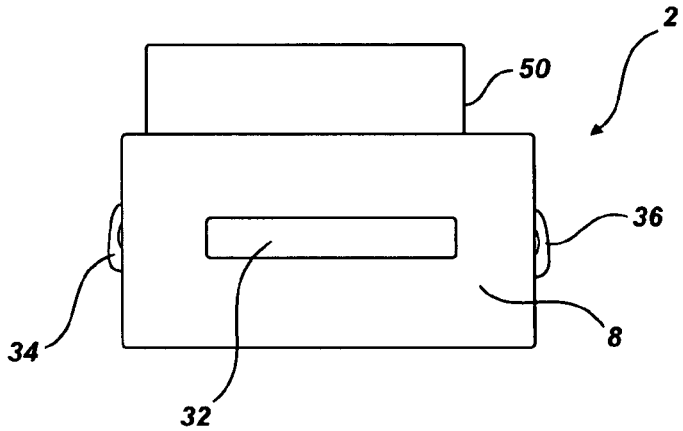
FIG. 3 shows an end view of the storage apparatus.

FIG. 1 shows a perspective view of the storage apparatus 2, FIG. 2 shows a top view of the storage apparatus 2, and FIG. 3 shows an end view of the storage apparatus 2. Storage apparatus 2 is in essence a "body bag" for storage and transportation of dead game animals after they have been killed and cleaned.

Storage apparatus 2 comprises a bag 4 that has two ends, a first end 6 and a second end 8, and furthermore, has two sides, a first side 10 and a second side 12. The storage apparatus 2 also has two surfaces, a top surface 14 and a bottom surface 16. The material that bag 4 is comprised of is designed to be waterproof, which prevents body fluids from dead game animals from leaking out while they are being transported. Furthermore, it prevents melted ice from leaking out as well.

The storage apparatus 2 can come in a wide variety of lengths, but has enough fabric to stretch out to have preferred dimensions of six feet in length, three feet in width, and two feet in height. These dimensions provide plenty of room for most game animals.

The top surface 14 of the bag 4 includes an opening 18 which can be opened or closed by a zipper 20. Opening 18 runs along the second end 8 of the bag 2, then the first side 10 of the bag 4, and then the first end 6 of the bag 4. The entire length of the opening 18 is along the top surface 14 of the bag 4 and when completely opened, allows an individual to place items such as dead animal carcasses and ice into the bag 4 quite easily.

Storage apparatus 2 also has a plurality of straps attached to the bag 4. The first end 6 of the bag 2 has a strap 30, while the second end 8 of the bag 2 has a strap 32. Furthermore, the first side 10 of the bag 2 has a strap 34, while the second side 12 of the bag 2 has a strap 36. Each of the straps 30-36 are preferably fabricated from nylon and also for easy grasping of the storage apparatus 2, especially when it is full.

On the top surface 14 of the bag 4 near the first end 6 of the bag 2 is located head pouch 50. Head pouch 50 provides extra room for the head of a killed animal carcass, especially if the head includes antlers. The volume within the head pouch 50 is contiguous with the volume within the bag 4 and will only extend if an object within the bag 4 is large enough to push it upwards. The head pouch 50 itself adds up to another twelve (12) to eighteen (18) inches of height to height of the bag 4 itself.

We claim:

1. A storage apparatus for dead game animals comprising:

a bag having a first end, a second end, a first side, a second side, a top surface, and a bottom surface, the bag having a first length a first width, and a first height, an opening located on the top surface of the bag, the opening running along the second end of the bag, the opening also running along the first side of the bag, the opening also running along the first end of the bag, wherein the entire length of the opening runs along the top surface of the bag, means for opening and closing the opening located on the top surface of the bag, a first pair of straps comprising a first strap and a second strap, the first strap attached to the first end of the bag, the second strap attached to the second end of the bag, a second pair of straps comprising a third strap and a fourth strap, the third strap attached to the first side of the bag, the fourth strap attached to the second side of the bag, and a head pouch attached to the top surface of the bag near the first end of the bag only, the head pouch extendable above the top surface of the bag and providing extra room for the head of a killed animal carcass, the volume within the head pouch being contiguous with the volume within the bag, wherein when the head pouch is extended above the top surface of the bag, the head pouch has four substantially vertical side walls having a second height.

2. A storage apparatus for dead game animals according to claim 1 wherein the second height of the side walls of the head pouch have a height between twelve (12) to eighteen (18) inches.

3. A storage apparatus for dead game animals according to claim 1 wherein the means for opening and closing the opening located on the top surface of the bag further comprises a zipper.

4. A storage apparatus for dead game animals according to claim 1 wherein the first and second straps of the first pair of straps and the third and fourth straps of the second pair of straps are all fabricated from nylon.

5. A storage apparatus for dead game animals according to claim 1 wherein the bag has a length of six feet, a width of three feet, and a height of two feet.

6. A storage apparatus for dead game animals according to claim 1 wherein the bag is fabricated from a waterproof material.

7. A storage apparatus for dead game animals according to claim 1 wherein the third strap and the fourth strap extend substantially along the entire length of the bag.

* * * * *